US011549694B2

(12) United States Patent
Huynh et al.

(10) Patent No.: US 11,549,694 B2
(45) Date of Patent: Jan. 10, 2023

(54) MOVABLE FAN ASSEMBLY OF A HEATING, VENTILATION, AND/OR AIR CONDITIONING (HVAC) UNIT

(71) Applicant: Johnson Controls Tyco IP Holdings LLP, Milwaukee, WI (US)

(72) Inventors: Marc Huynh, Norman, OK (US); Neelkanth S. Gupte, Katy, TX (US); Zhiwei Huang, Flower Mound, TX (US); Kirankumar A. Muley, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 130 days.

(21) Appl. No.: 16/744,015

(22) Filed: Jan. 15, 2020

(65) Prior Publication Data

US 2021/0215356 A1 Jul. 15, 2021

(51) Int. Cl.
*F24F 1/029* (2019.01)

(52) U.S. Cl.
CPC ..... *F24F 1/029* (2019.02)

(58) Field of Classification Search
CPC ..... F24F 1/24; F24F 1/22; F24F 1/48
See application file for complete search history.

(56) References Cited

U.S. PATENT DOCUMENTS 6,065,296 A 5/2000 Feger
7,086,825 B2 8/2006 Wang et al.
2007/0171613 A1* 7/2007 McMahan ..... H05K 7/20736 361/695
2011/0277495 A1* 11/2011 Lee ..... F24F 1/0057 62/428
2015/0059389 A1* 3/2015 Liu ..... F24F 1/24 62/259.2
2018/0356124 A1 12/2018 Gupte et al.

FOREIGN PATENT DOCUMENTS

CN 104654466 5/2015
CN 209325925 U * 8/2019 ..... F24F 1/0011
WO WO-2019172693 A1 * 9/2019 ..... F24F 1/00

OTHER PUBLICATIONS

WO2019172693A1 Translation (Year: 2019).*
CN209325925U Translation (Year: 2019).*

* cited by examiner

*Primary Examiner* — Schyler S Sanks
(74) *Attorney, Agent, or Firm* — Fletcher Yoder, P.C.

(57) ABSTRACT

A heating, ventilation, and/or air conditioning (HVAC) unit includes a cabinet defining a cabinet interior configured to house components of the HVAC unit. The cabinet includes an opening defining an air flow path between the cabinet interior and an external environment. The HVAC unit also includes a fan assembly including fan blades configured to move an air flow through the opening, wherein the fan assembly is configured to enable translation of the fan blades through the opening between a shipping arrangement in which the fan blades are disposed in the cabinet interior and an operational arrangement in which the fan blades are disposed in the external environment.

15 Claims, 11 Drawing Sheets

MOVABLE FAN ASSEMBLY OF A HEATING, VENTILATION, AND/OR AIR CONDITIONING (HVAC) UNIT

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. The HVAC system may control the environmental properties through the control of an airflow delivered to the conditioned environment. For example, the HVAC system may include a condenser used to cool and condense a gaseous refrigerant, via heat exchange with an air flow over the condenser, to convert the gaseous refrigerant to a liquid state. The air flow may be caused by a fan disposed in or around a cabinet of the condenser. Other components of the HVAC system may also include a fan disposed in or around a cabinet. It is now recognized that, in traditional HVAC systems, the fan may be mounted within a cabinet interior of the cabinet in a manner that reduces air flow efficiency, or mounted along a cabinet exterior in a manner that increases a volume or size of the condenser, which can contribute to increased shipping costs.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and/or air conditioning (HVAC) unit. The HVAC unit includes a cabinet defining a cabinet interior configured to house components of the HVAC unit, and having an opening defining an air flow path between the cabinet interior and an external environment surrounding the cabinet. The HVAC unit also includes a fan assembly including fan blades configured to move an air flow through the opening. The fan assembly is configured to be moved through the opening and between a shipping arrangement in which the fan assembly is disposed entirely within the cabinet interior and an operational arrangement in which the fan assembly extends into the external environment.

The present disclosure also relates to a condenser unit including a cabinet defining a cabinet interior configured to house components of the condenser unit. The cabinet also includes an opening defining an air flow path between the cabinet interior and an external environment surrounding the cabinet. The condenser unit includes a fan assembly including fan blades and a fan motor coupled to the fan blades and configured to drive the fan blades into rotation. The condenser unit also includes a fan movement assembly configured to enable movement of the fan assembly through the opening and between a shipping position in which the fan assembly is disposed entirely within the cabinet interior and an operational position in which the fan assembly extends partially or entirely outside of the cabinet interior into the external environment.

The present disclosure also relates to a heating, ventilation, and/or air conditioning (HVAC) system. The HVAC system includes a cabinet defining a cabinet interior configured to house components of the HVAC system. The cabinet includes an opening defining an air flow path between the cabinet interior and an external environment surrounding the cabinet. The HVAC system also includes a fan assembly including fan blades, a blade housing, and a grill mounted to the blade housing. The HVAC system also includes a fan movement assembly configured to enable movement of the fan assembly through the opening and between a shipping position in which the fan assembly is disposed entirely within the cabinet interior and an operational position in which the fan assembly extends partially or entirely outside of the cabinet interior into the external environment.

DETAILED DESCRIPTION

Figure 1:
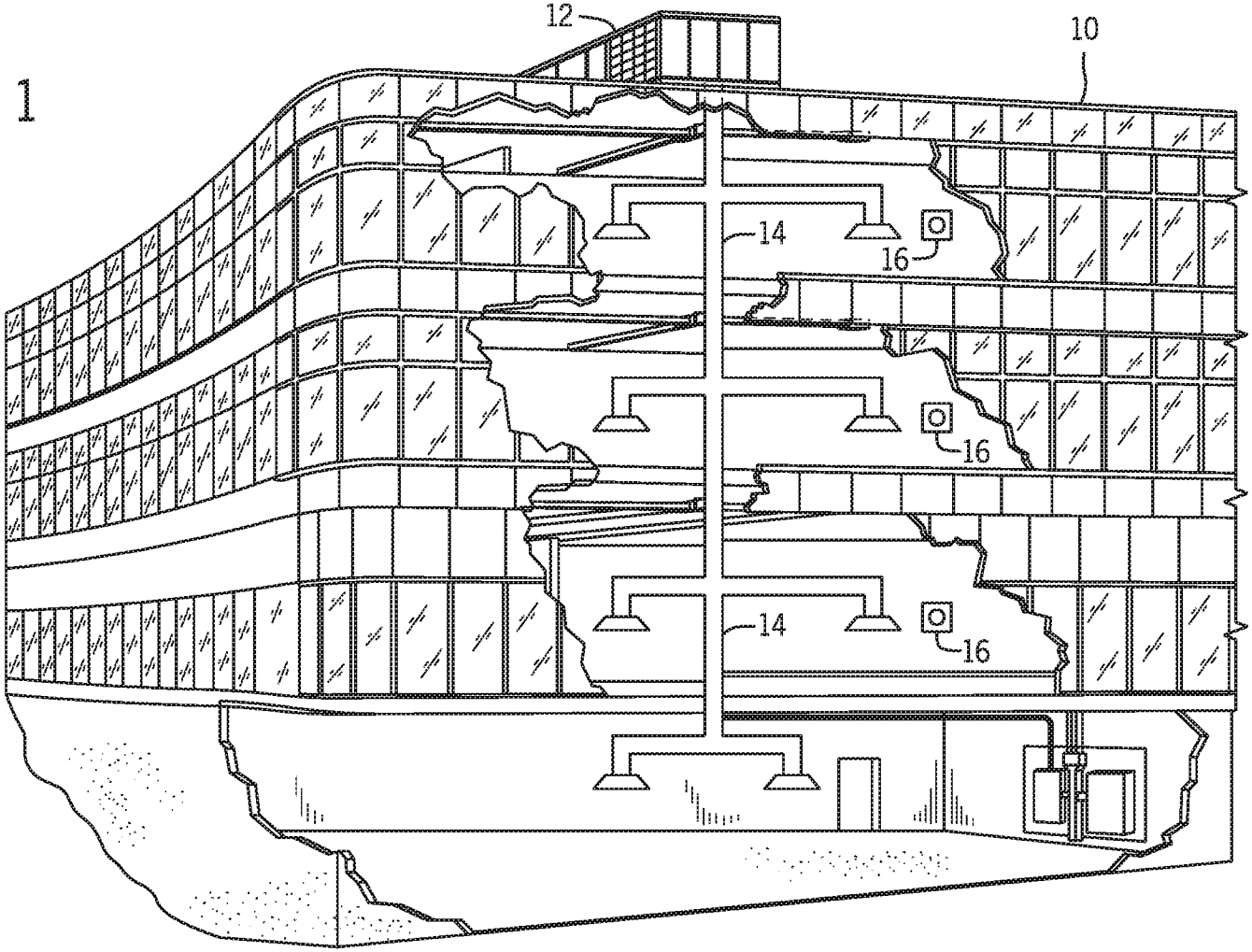
FIG. 1 is a perspective view of an embodiment of a building having a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system in accordance with the present disclosure may include a fan assembly that is movable, such as translatable from a first position to a second position. In traditional systems, a fan may be mounted within a cabinet interior of the cabinet in a manner that reduces air flow efficiency, or mounted along a cabinet exterior in a manner that increases a volume or size of the condenser, which can contribute to increased shipping costs. The fan assembly in accordance with the present disclosure is movable, such as translatable, between a shipping position in which the fan assembly is disposed entirely within an interior of the condenser, and an operational position in which the fan assembly at least partially extends outside of the interior of the condenser. By including the fan assembly in the shipping position during shipping, a geometry and a volume of the condenser is improved for purposes of reducing a shipping cost of the condenser and/or multiple condensers. Further, by including the fan assembly in the operational position during operation of the condenser, a performance of the condenser is improved. The condenser may include a movement assembly, such as a translation assembly, that facilitates simple and cost effective movement of the fan assembly between the shipping position and the operational position. The movement assembly may include, depending on the embodiment, fasteners, guide rails, wheels, flanges, extensions, and/or other features that enable simple and cost-effective movement of the fan assembly between the shipping position and the operational position. These features will be described in detail below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
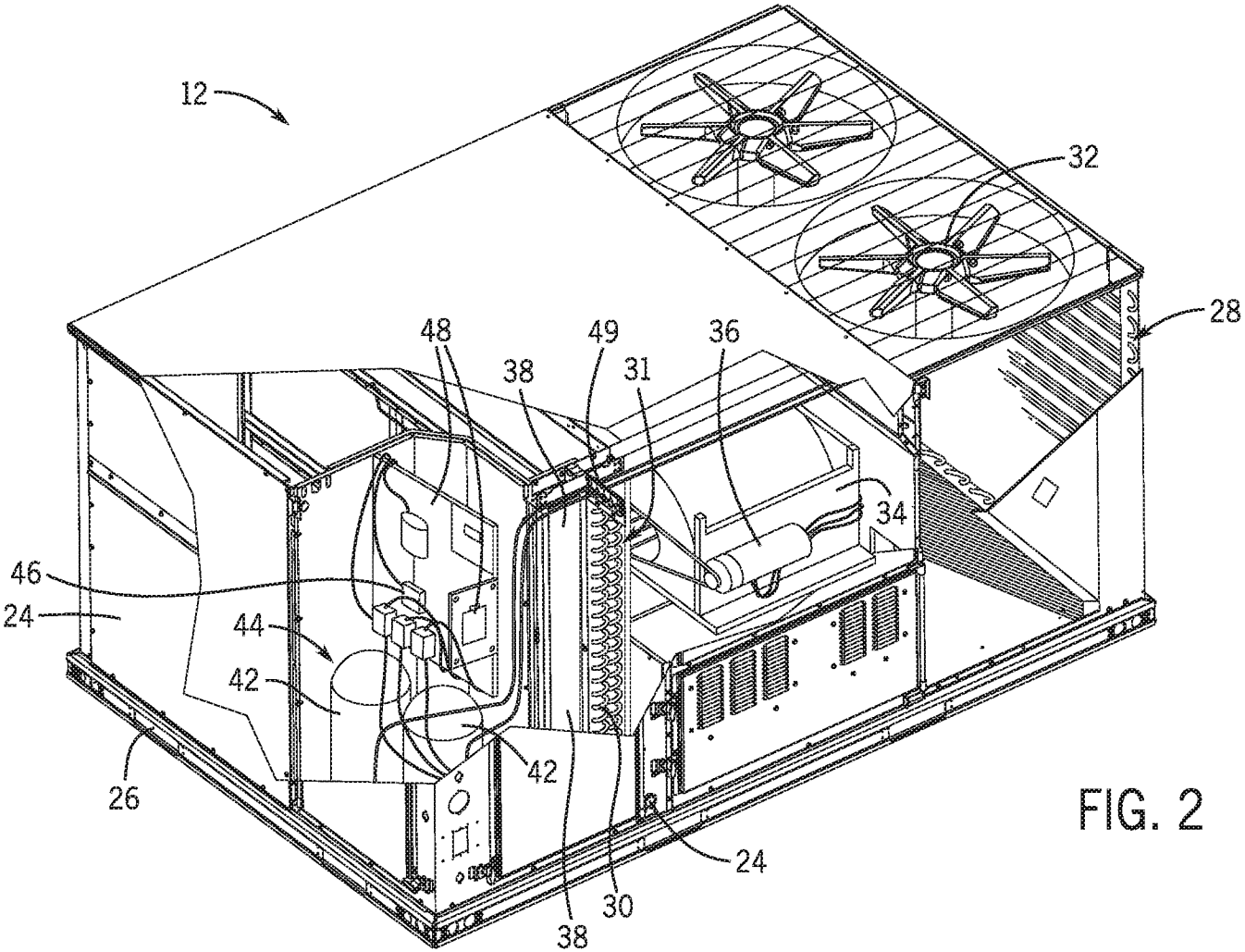
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
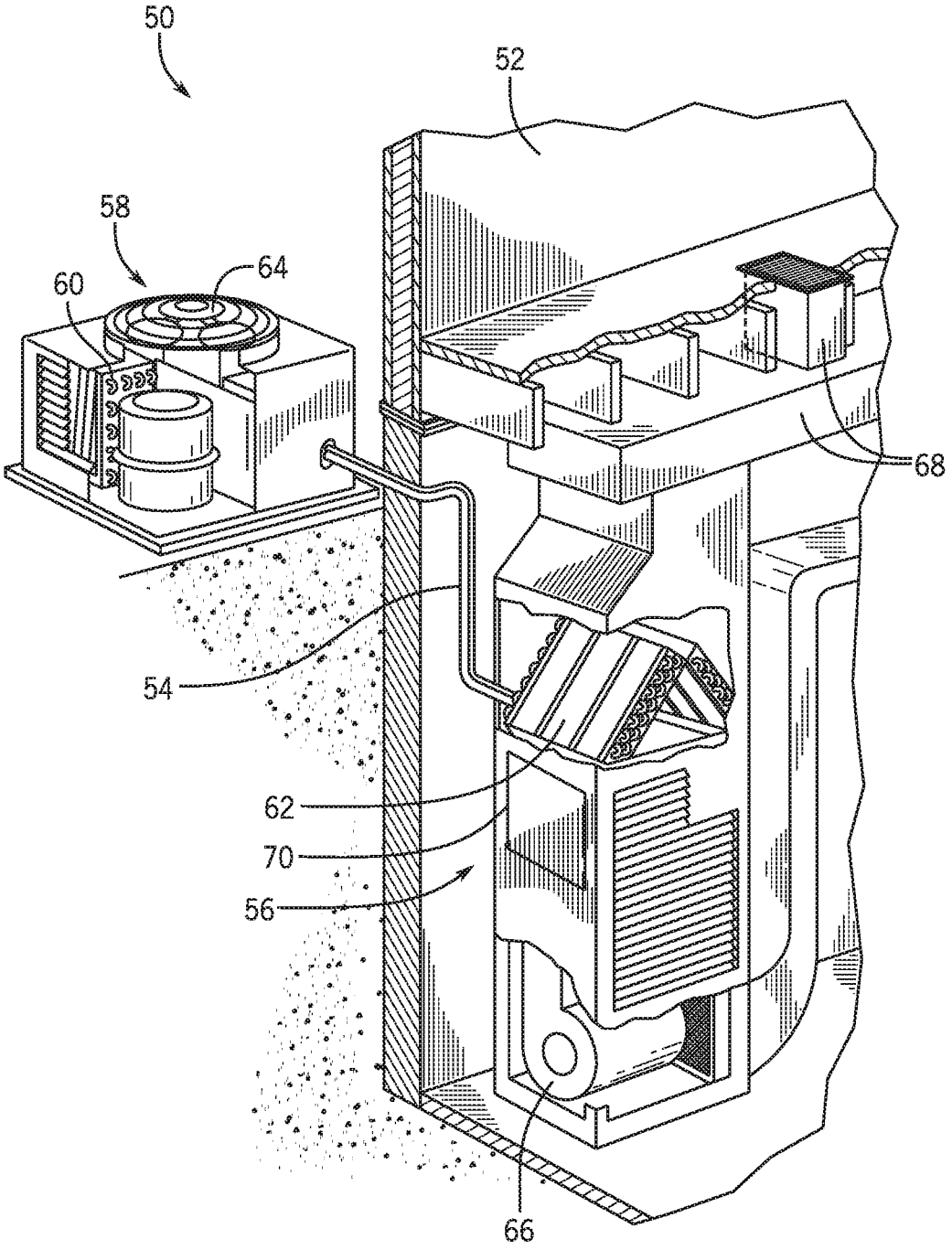
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
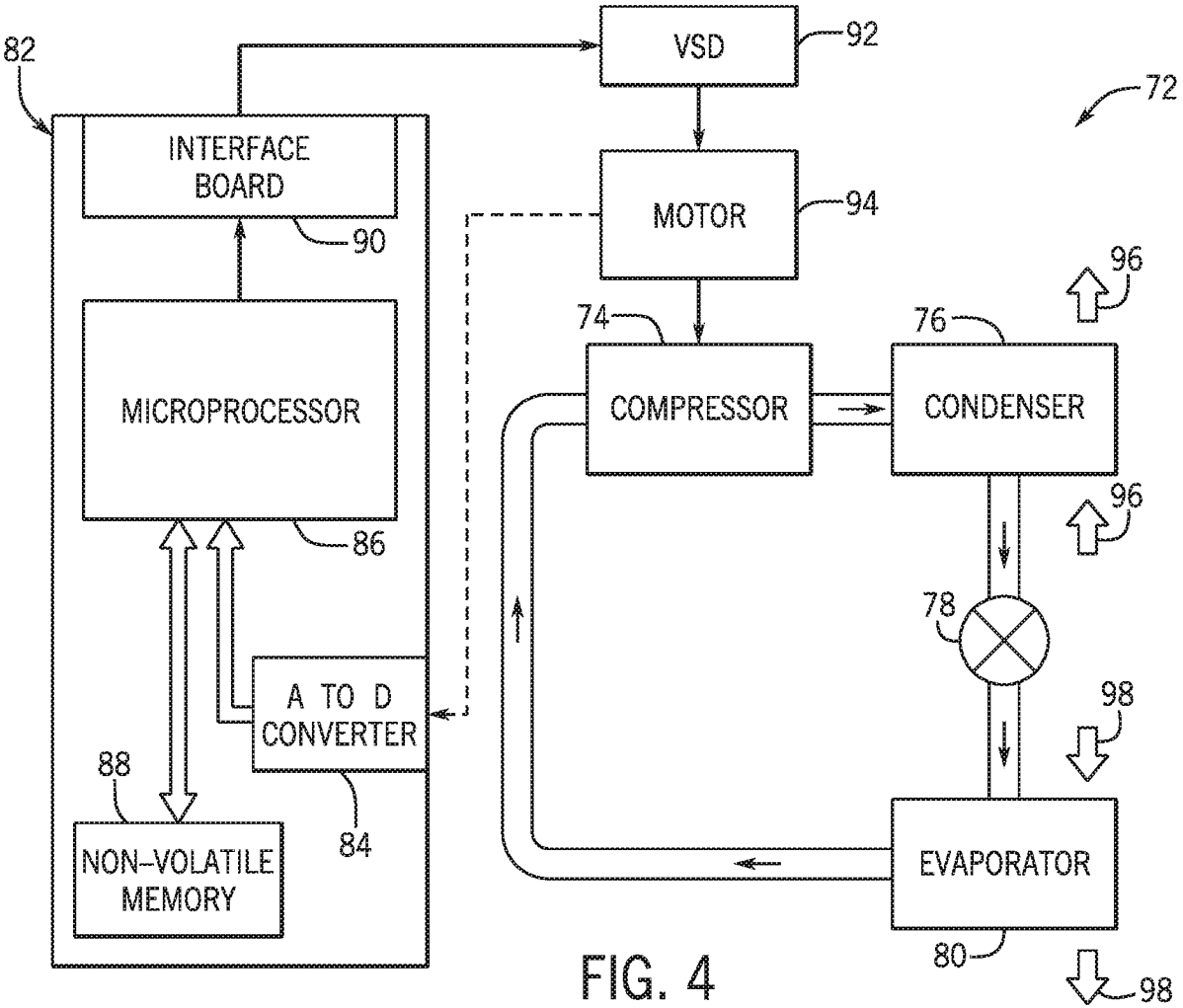
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, any of the HVAC systems in FIGS. 1-4 may include a condenser that is movable, such as translatable, between a shipping position in which the fan assembly is disposed entirely within an interior of the condenser, and an operational position in which the fan assembly at least partially extends outside of the interior of the condenser. For example, any of the heat exchangers 28, 30, 60, 76 illustrated in FIGS. 1-4 (including any heat exchangers associated with the HVAC unit 12 of FIG. 1) may include a condenser having a fan assembly movable between the shipping position and the operational position. By including the fan assembly in the shipping position during shipping, a geometry and a volume of the condenser is improved for purposes of reducing a shipping cost of the condenser and/or multiple condensers. Further, by including the fan assembly in the operational position during operation of the condenser, a performance of the condenser is improved. The condenser may include a movement assembly, such as a translation assembly, that facilitates simple and cost effective movement of the fan assembly between the shipping position and the operational position. The movement assembly may include, depending on the embodiment, fasteners, guide rails, wheels, flanges, extensions, and/or other features that enable simple and cost-effective movement of the fan assembly between the shipping position and the operational position. These features will be described in detail below with reference to the FIGS. 5-18. For ease of illustration and description, reference numeral 102 will denote the condenser unit(s) described below with respect to FIGS. 5-18. In other words, it should be understood that any of the heat exchangers 28, 30, 60, 76 illustrated in FIGS. 1-4 (including any heat exchangers associated with the HVAC unit 12 in FIG. 1) may correspond to the condenser unit(s) 102 illustrated in FIGS. 5-18 and described with respect to FIGS. 5-18 below.

Figure 5:
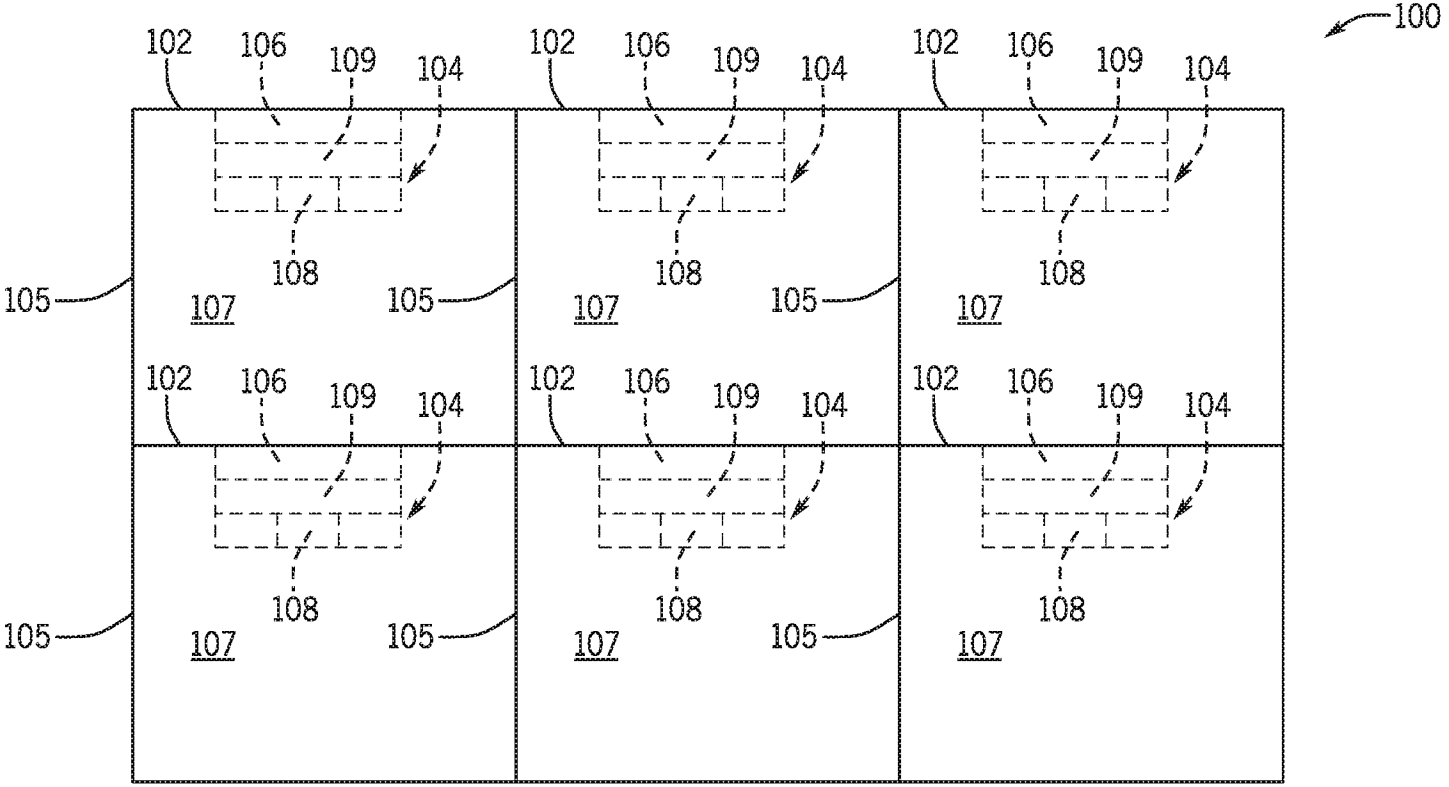
FIG. 5 is a schematic illustration of a stack of condenser units in a shipping arrangement, each condenser having a movable fan assembly, in accordance with an aspect of the present disclosure.

With the foregoing in mind, FIG. 5 is a schematic illustration of an embodiment of a stack 100 of condenser units 102 in a shipping arrangement, each condenser unit 102 having a movable fan assembly 104. As shown, the condenser units 102 may be positioned in rows and columns in the shipping arrangement. For example, at least one condenser unit 102 may be stacked on top of at least one other condenser unit 102 in the shipping arrangement. In the illustrated embodiment, the movable fan assembly 104 of each condenser unit 102 is disposed entirely within an interior 107 of a cabinet 105 of the corresponding condenser unit 102. Each of the illustrated positions of the movable fan assembly 104 entirely within the interior 107 of the cabinet 105 of the condenser unit 102 may be referred to herein as a shipping position. By including the movable fan assembly 104 entirely within the interior 107 of the cabinet 105 of the condenser unit 102 in the shipping position, the geometry of the cabinet 105 is kept flat and smooth for abutting another flat and smooth cabinet 105 adjacent thereto. By including the movable fan assemblies 104 in the illustrated shipping positions, a geometry and volume of the condenser units 102 is improved relative to traditional embodiments, thereby reducing shipping costs and complexities associated with traditional embodiments. For example, by including the movable fan assemblies 104 in the illustrated shipping arrangements, the stacking surfaces of the cabinets 105 may be smooth compared to traditional configurations, and a volume of the condensers 102 may be reduced compared to traditional configurations.

Although the illustrated condenser units 102 include the movable fan assemblies 104 disposed along upper sides of the cabinets 105 based on the illustrated perspective, the movable fan assemblies 104 may be disposed adjacent any sides of the cabinets 105. That is, the technical benefits associated with the disclosed movable fan assembly 104 may be present regardless of which side of the cabinet 105 is closest to, or receives, the movable fan assembly 104. As shown, the movable fan assembly 104 may include at least a grill 106, a motor 108, and fan blades 109. The movable fan assembly 104 having at least the grill 106, the motor 108, and the fan blades 109 may be pre-assembled prior to disposal of the movable fan assembly 104 in the shipping position within the interior 107 of the cabinet 105 of the condenser unit 102.

Figure 6:
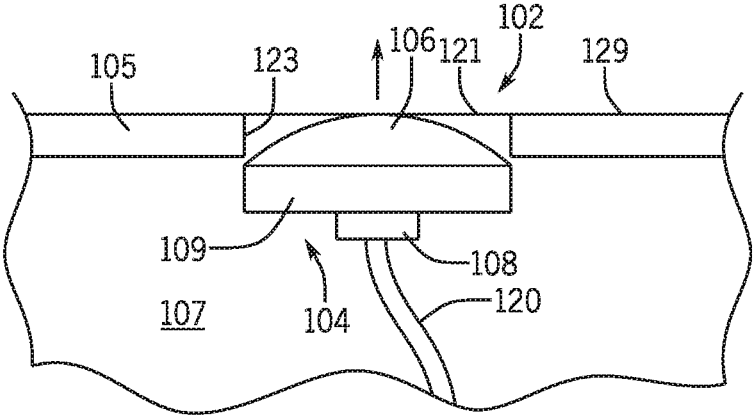
FIG. 6 is a schematic cross-sectional view of a condenser unit having a movable fan assembly disposed in a shipping position within an interior of the condenser unit, in accordance with an aspect of the present disclosure.
Figure 7:
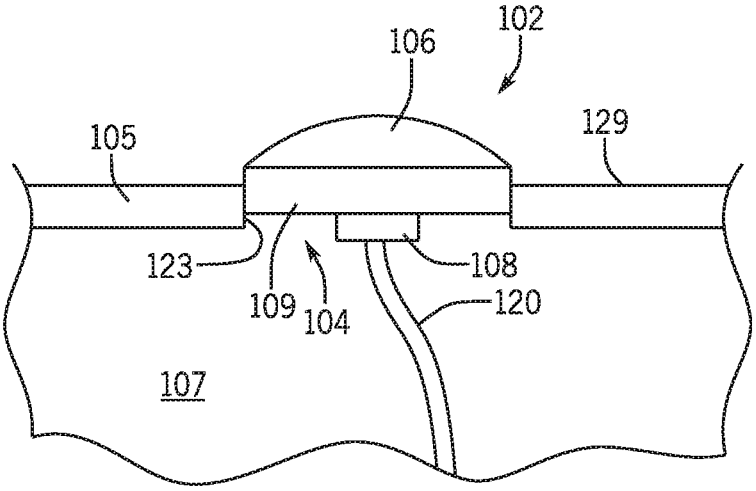
FIG. 7 is a schematic cross-sectional view of the condenser unit of FIG. 6 with the movable fan assembly disposed in an operational position at least partially external to the interior of the condenser unit, in accordance with an aspect of the present disclosure.

FIG. 6 is a schematic cross-sectional view of an embodiment of the condenser unit 102 having the movable fan assembly 104 disposed in the shipping position. In other words, FIG. 6 illustrates the movable fan assembly 104 disposed entirely within the interior 107 of the cabinet 105 of the condenser unit 102. FIG. 7 is a schematic cross-sectional view of the condenser unit 102 of FIG. 6, with the movable fan assembly 104 disposed in an operational position at least partially external to the interior 107 of the cabinet 105 of the condenser unit 102. FIGS. 6 and 7 do not include the movement assemblies that may be utilized to move the fan assembly 104, and are included instead to show the shipping position in FIG. 6 and the operational position in FIG. 7. A cover 121 may be disposed over an opening 123 through a wall 129 (or side) of the cabinet 105 while the fan assembly 104 is in the shipping position. The cover 121 may be removed, as illustrated in FIG. 7, to enable the movable fan assembly 104 to be moved through the opening 123 in the wall 129 when the movable fan assembly 104 is moved from the shipping position of FIG. 6 to the operational position of FIG. 7. In some embodiments, no cover may be used, or the cover may be formed by the grill 106 of the movable fan assembly 104. As shown, an electrical cable 120 may extend from the motor 108 configured to drive the fan blades 109 into rotation. The electrical cable 120 may be configured to transmit power to the motor 108, and/or transmit data to and from the motor 108. The electrical cable 120 may be pre-attached to an electrical outlet, electrical lead, printed circuit board (PCB), battery, and/or any other electrical contact in the interior 107 of the cabinet 105, or external to the cabinet 105, prior to, or after, moving the movable fan assembly 104 from the shipping position to the operational position. For example, in some embodiments, the electrical cable 120 and corresponding connections may be pre-assembled prior to shipment and operation.

Figure 10:
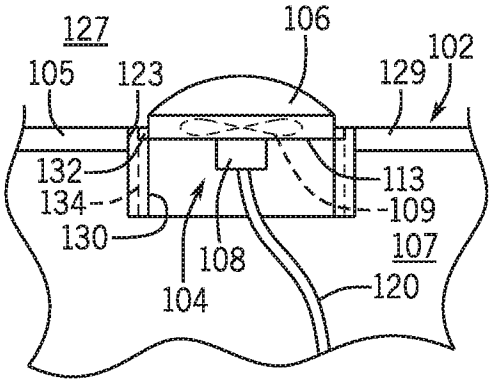
FIG. 10 is a schematic cross-sectional view of the condenser unit of FIG. 8 with the movable fan assembly disposed in an operational position at least partially external to the interior of the condenser unit, in accordance with an aspect of the present disclosure.
Figure 9:
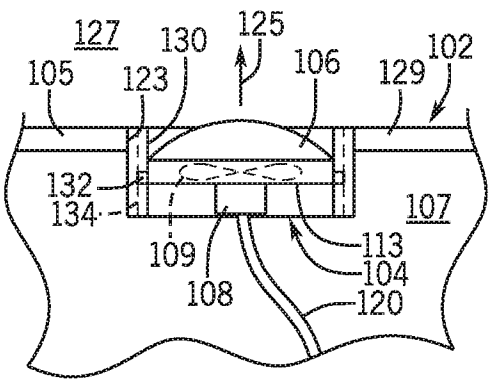
FIG. 9 is a schematic cross-sectional view of the condenser unit of FIG. 8 with the movable fan assembly being moved from the shipping position within the interior of the condenser unit toward an operational position at least partially external to the interior of the condenser unit, in accordance with an aspect of the present disclosure.
Figure 8:
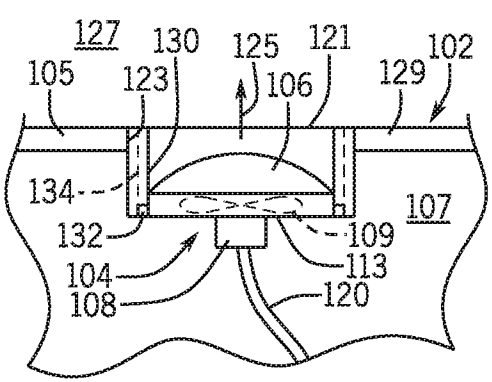
FIG. 8 is a schematic cross-sectional view of a condenser unit having a movable fan assembly disposed in a shipping position within an interior of the condenser unit, in accordance with an aspect of the present disclosure.
Figure 11:
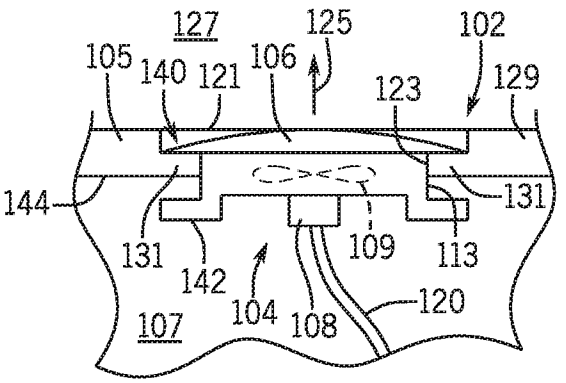
FIG. 11 is a schematic cross-sectional view of a condenser unit having a movable fan assembly disposed in a shipping position within an interior of the condenser unit, in accordance with an aspect of the present disclosure.
Figure 12:
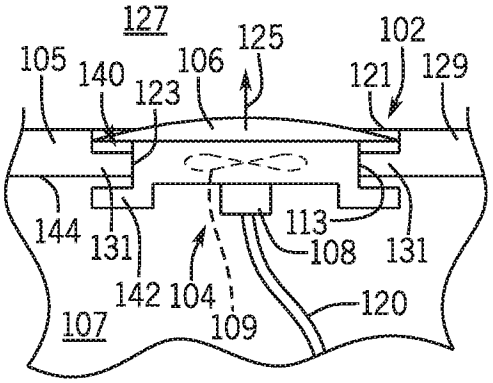
FIG. 12 is a schematic cross-sectional view of the condenser unit of FIG. 11 with the movable fan assembly being moved from the shipping position within the interior of the condenser unit toward an operational position at least partially external to the interior of the condenser unit, in accordance with an aspect of the present disclosure.
Figure 13:
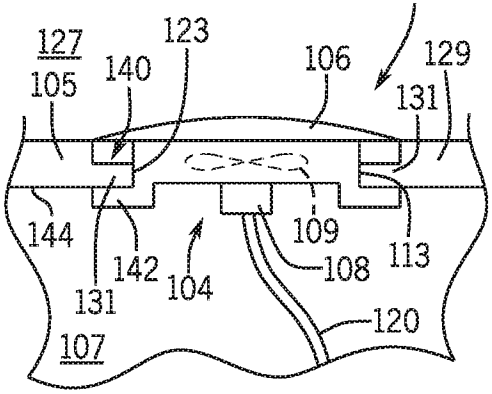
FIG. 13 is a schematic cross-sectional view of the condenser unit of FIG. 11 with the movable fan assembly disposed in an operational position at least partially external to the interior of the condenser unit, in accordance with an aspect of the present disclosure.
Figure 16:
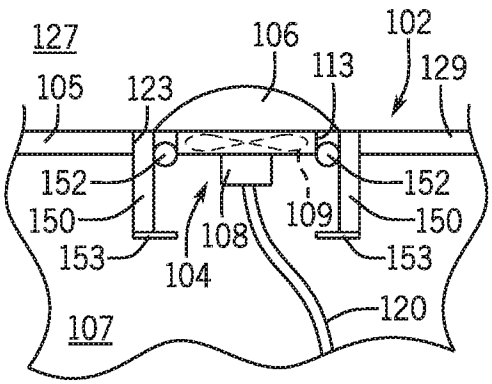
FIG. 16 is a schematic cross-sectional view of the condenser unit of FIG. 14 with the movable fan assembly disposed in an operational position at least partially external to the interior of the condenser unit, in accordance with an aspect of the present disclosure.
Figure 15:
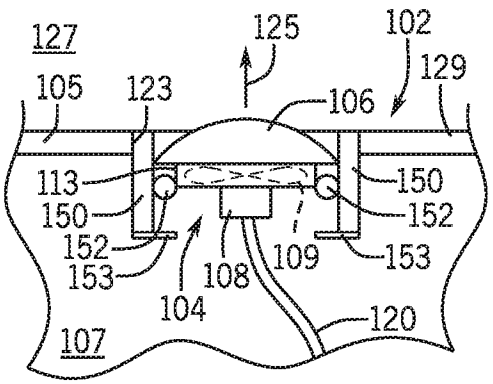
FIG. 15 is a schematic cross-sectional view of the condenser unit of FIG. 14 with the movable fan assembly being moved from the shipping position within the interior of the condenser unit toward an operational position at least partially external to the interior of the condenser unit, in accordance with an aspect of the present disclosure.
Figure 14:
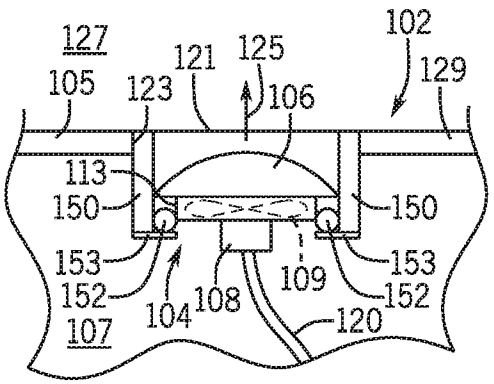
FIG. 14 is a schematic cross-sectional view of a condenser unit having a movable fan assembly disposed in a shipping position within an interior of the condenser unit, in accordance with an aspect of the present disclosure.
Figure 18:
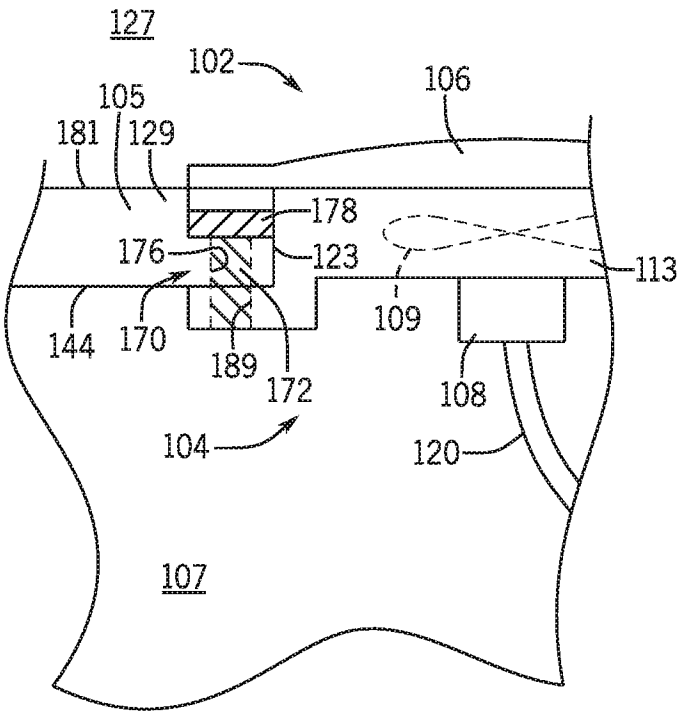
FIG. 18 is a schematic cross-sectional view of the condenser unit of FIG. 17 with the movable fan assembly disposed in an operational position at least partially external to the interior of the condenser unit, in accordance with an aspect of the present disclosure.
Figure 17:
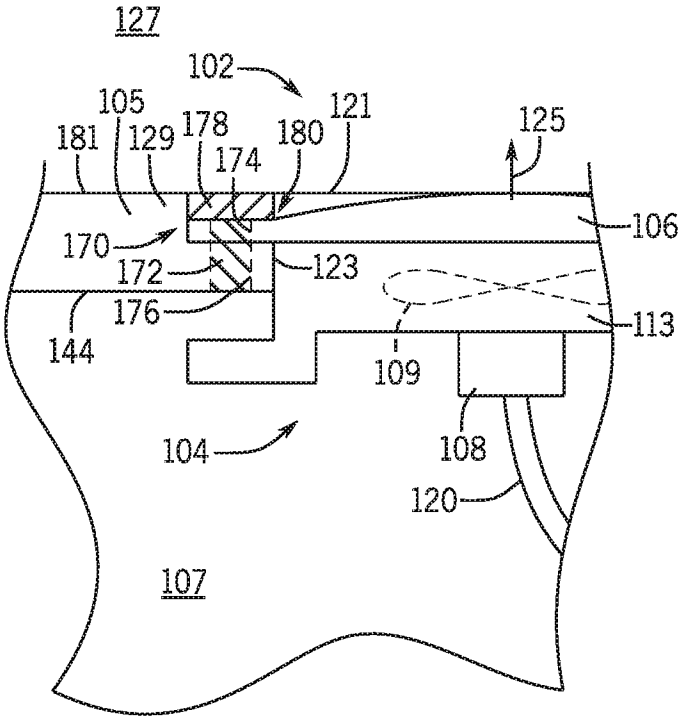
FIG. 17 is a schematic cross-sectional view of a condenser unit having a movable fan assembly disposed in a shipping position within an interior of the condenser unit, in accordance with an aspect of the present disclosure.

FIGS. 8-18 illustrate various embodiments of the condenser unit 102 in accordance with the present disclosure. For example, FIGS. 8-10 illustrate a first embodiment of the condenser unit 102 in which the fan assembly 104 is transitioned from the shipping position to the operational position via a guide rail engagement, FIGS. 11-13 illustrate a second embodiment of the condenser unit 102 in which the fan assembly 104 is transitioned from the shipping position to the operational position via a footing engagement, FIGS. 14-16 illustrate a third embodiment of the condenser unit 102 in which the fan assembly 104 is transitioned from the shipping position to the operational position via roller wheel engagement, and FIGS. 17 and 18 illustrate a fourth embodiment of the condenser unit 102 in which the fan assembly 104 is transitioned from the shipping position to the operational position via a fastener engagement. The guide rail engagement of FIGS. 8-10, the footing engagement of FIGS. 11-13, the roller wheel engagement of FIGS. 14-16, and the fastener engagement of FIGS. 17 and 18 may include various components that form what is referred to herein as a "fan movement assembly." In some embodiments, components of the "fan movement assembly" may be shared by the fan assembly 104. While these embodiments are described in detail below with reference to FIGS. 8-18, it should be appreciated that other variations are also possible in accordance with the present disclosure.

FIG. 8 is a schematic cross-sectional view of an embodiment of the condenser unit 102 having the movable fan assembly 104 disposed in a shipping position within the interior 107 of the cabinet 105 of the condenser unit 102. In the illustrated embodiment, guide rails 130 may be disposed on opposing sides of the fan assembly 104, or a single guide rail may circumferentially surround the fan assembly 104. The guide rail(s) 130 may be attached to the cabinet 105. In some embodiments, the guide rail(s) 130 may be integrally formed with the cabinet 105. In general, the illustrated guide rail(s) 130 may be stationary relative to movement of the fan assembly 104 in an axial direction 125 relative to the guide rail(s) 130. As shown, the guide rail(s) 130 may include one or more slots 134 therein that are configured to receive extensions 132 of the fan assembly 104. For example, the extension(s) 132 may extend from a fan blade housing 113 in which the fan blades 109 are disposed.

As shown in FIG. 9, a slidable engagement between the extension(s) 132 of the fan assembly 104 and the slot(s) 134 of the guide rail(s) 130 enables movement of the fan assembly 104 in the axial direction 125. For example, the slidable engagement between the extension(s) 132 and the slot(s) 134 may enable movement of the fan assembly 104 from the shipping position, in which the fan assembly 104 is contained entirely within the cabinet interior 107, through the air flow opening 123 and toward the operational position, in which the fan assembly 104 extends at least partially into an external environment 127 surrounding the cabinet 105. The cable 120 electrically connecting the fan motor 108 to a power source and/or other electronic componentry may include slack that enables movement of the fan assembly 104 between the shipping position and the operational position. FIG. 10 illustrates the fan assembly 104 mounted in the operational position extending at least partially into the external environment 127 surrounding the cabinet 105. To retain the fan assembly 104 in the operational position, fasteners may be used to couple the fan assembly 104 to the cabinet 105 and/or guide rail(s) 130. Additionally or alternatively, the extension(s) 132 may engage a retaining feature in the guide rail(s) 130, such as via a snap-fit connection, rotation into an offset position of the extension(s) 132 relative to the slot(s) 134, a magnetic connection, a spring-loaded hinge or other connection. As previously described, the shipping position illustrated in FIG. 8 enables reduced shipping costs and complexities by reducing a volume of the condenser unit 102 compared to externally mounted fans, while the operational position illustrated in FIG. 10 enables improved performance of the condenser unit 102 by expanding the air flow volume within the cabinet 105 of the condenser unit 102.

FIG. 11 is a schematic cross-sectional view of an embodiment of the condenser unit 102 having the movable fan assembly 104 disposed in the shipping position within the interior 107 of the cabinet 105 of the condenser unit 102. In the illustrated embodiment, the cabinet 105 includes cabinet extensions 131 disposed on opposing sides of the fan assembly 104, or a single cabinet extension may circumferentially surround the fan assembly 104. Recesses 140, or a single circumferential recess, in the cabinet 105 may be disposed above the cabinet extension(s) 131 and define the cabinet extension(s) 131. The cabinet extension(s) 131 may be integrally formed with the cabinet 105, as shown, or otherwise attached to the cabinet 105. A feature of the fan assembly 104 may engage the cabinet extension(s) 131 while the fan assembly 104 is in the shipping position. For example, as shown, the grill 106 of the fan assembly 104 may sit within the recess(es) 140 above the cabinet extension(s) 131.

As shown in FIG. 12, the fan assembly 104 may be slid in the axial direction 125 from the shipping position, through the air flow opening 123, and toward the operational position. A Footing 142 or footings of the fan assembly 104, for example of the fan blade housing 113, may be configured to engage an underside 144 of the cabinet extension(s) 131 once the fan assembly 104 is in the operational position, as shown in FIG. 13. To retain the fan assembly 104 in the operational position, fasteners may be used to couple the footing(s) 142 of the fan assembly 104 to the cabinet extension(s) 131 of the cabinet 105. Additionally or alternatively, the footing(s) 142 may engage retaining features of the cabinet extension(s) 131, such as via a snap-fit connection, a magnetic connection, a spring-loaded hinge, rotation into a receptacle, or other connection. As previously described, the shipping position illustrated in FIG. 11 enables reduced shipping costs and complexities by reducing a volume of the condenser unit 102 compared to externally mounted fans, while the operational position illustrated in FIG. 13 enables improved performance of the condenser unit 102 by expanding the air flow volume within the cabinet 105 of the condenser unit 102.

FIG. 14 is a schematic cross-sectional view of an embodiment of the condenser unit 102 having the movable fan assembly 104 disposed in a shipping position within the interior 107 of the cabinet 105 of the condenser unit 102. In the illustrated embodiment, roller tracks 150 may be disposed on opposing sides of the fan assembly 104, or a single roller track may circumferentially surround the fan assembly 104. The roller track (s) 150 may be attached to the cabinet 105. In some embodiments, the roller track(s) 150 may be integrally formed with the cabinet 105. In general, the illustrated roller track(s) 150 may be stationary relative to movement of the fan assembly 104 in the axial direction 125 relative to the roller track(s) 150. As shown, two or more roller wheels 152 may be disposed between the roller track(s) 150 and the fan blade housing 113 of the fan assembly 104. Depending on the embodiment, the roller wheels 152 may be attached to the roller track(s) 150 or a feature of the fan assembly 104, such as the fan blade housing 113. Further, the roller track(s) 150 may include a stopper at a lower end of the roller track(s) 150 to stop the roller wheels 152 with the fan assembly 104 in the shipping position.

As shown in FIG. 15, the roller wheels 152 may enable movement of the fan assembly 104 in the axial direction 125. For example, the roller wheels 152 may enable movement of the fan assembly 104 from the shipping position, in which the fan assembly 104 is contained entirely within the cabinet interior 107, through the air flow opening 123 and toward the operational position, in which the fan assembly 104 extends at least partially into the external environment 127 surrounding the cabinet 105. FIG. 116 illustrates the fan assembly 104 mounted in the operational position extending at least partially into the external environment 127 surrounding the cabinet 105. To retain the fan assembly 104 in the operational position, the roller wheels 152 may be locked in position, for example via fasteners, once the fan assembly 104 is disposed in the operational position. Additionally or alternatively, the fan assembly 104 may engage a retaining feature in the roller track(s) 150 or other portion of the cabinet 105 of the condenser unit 102, such as via a snap-fit connection, a magnetic connection, a spring-loaded hinge or other connection. As previously described, the shipping position illustrated in FIG. 14 enables reduced shipping costs and complexities by reducing a volume of the condenser unit 102 compared to externally mounted fans, while the operational position illustrated in FIG. 16 enables improved performance of the condenser unit 102 by expanding the air flow volume within the cabinet 105 of the condenser unit 102.

FIG. 17 is a schematic cross-sectional view of an embodiment of the condenser unit 102 having the movable fan assembly 104 disposed in a shipping position within an interior 107 of the cabinet 105 of the condenser unit 102. In the illustrated embodiment, a fastener 170 may be used to maintain the fan assembly 104 in the shipping position. For example, the fastener 170 may include a threaded shank 172 that extends through an opening 174 in the fan assembly 104, such as in the fan grill 106, and through an opening 176 in the cabinet 105. The surfaces forming the openings 174, 176 may be threaded such that the surfaces engage the shank 172 of the fastener 170. The fastener 170 may also include a head 178 that sits in a recess 180 formed in the cabinet 105 exterior. As shown, the head 178 may sit beneath the upper portion of the air flow opening 123. That is, the head 178 may be flush with a top surface 181 of the cabinet 105, where the cabinet interior 107 includes anything underneath (or flush with) the upper surface 181 of the cabinet 105. Each of these configurations is considered to be fully inside the interior 107 of the cabinet 105. It should be noted that, in some embodiments, a cover 121 may be disposed over the fan grill 106 while the fan assembly 104 is in the shipping position, and that the cover 121 (illustrated in FIGS. 8, 11, 14, and 17) may be flush with the top surface 181 of the cabinet 105. The cover 121 is removed in FIGS. 9, 10, 12, 13, 15, 16, and 18 to enable movement of the fan assembly 104 through the air flow opening 123 and toward and into the operational position.

The fastener 170 may be removed from the openings 174, 176 while moving the fan assembly 104 from the shipping position, illustrated in FIG. 17, toward the operational position, illustrated in FIG. 18. Once the fan assembly 104 is disposed in the operational position illustrated in FIG. 18, the same fastener 170 from FIG. 17 may be utilized to retain the fan assembly 104 in the operational position of FIG. 18. For example, the shank 172 of the fastener 170 may extend through the opening 176 in the cabinet 105 and an opening 184 in the fan assembly 104 to mount the fan assembly 104 in the operational position. The opening 184 may be threaded to engage the threaded shank 172 of the fastener 170. In both of FIGS. 17 and 18, certain embodiments may include the shank 172 sized to extend beyond the underside 144 of the cabinet 105 wall, where the shank 172 may receive a nut that further reinforced the engagement between the fan assembly 104 and the cabinet 105. As previously described, the shipping position illustrated in FIG. 17 enables reduced shipping costs and complexities by reducing a volume of the condenser unit 102 compared to externally mounted fans, while the operational position illustrated in FIG. 18 enables improved performance of the condenser unit 102 by expanding the air flow volume within the cabinet 105 of the condenser unit 102.

Figure 19:
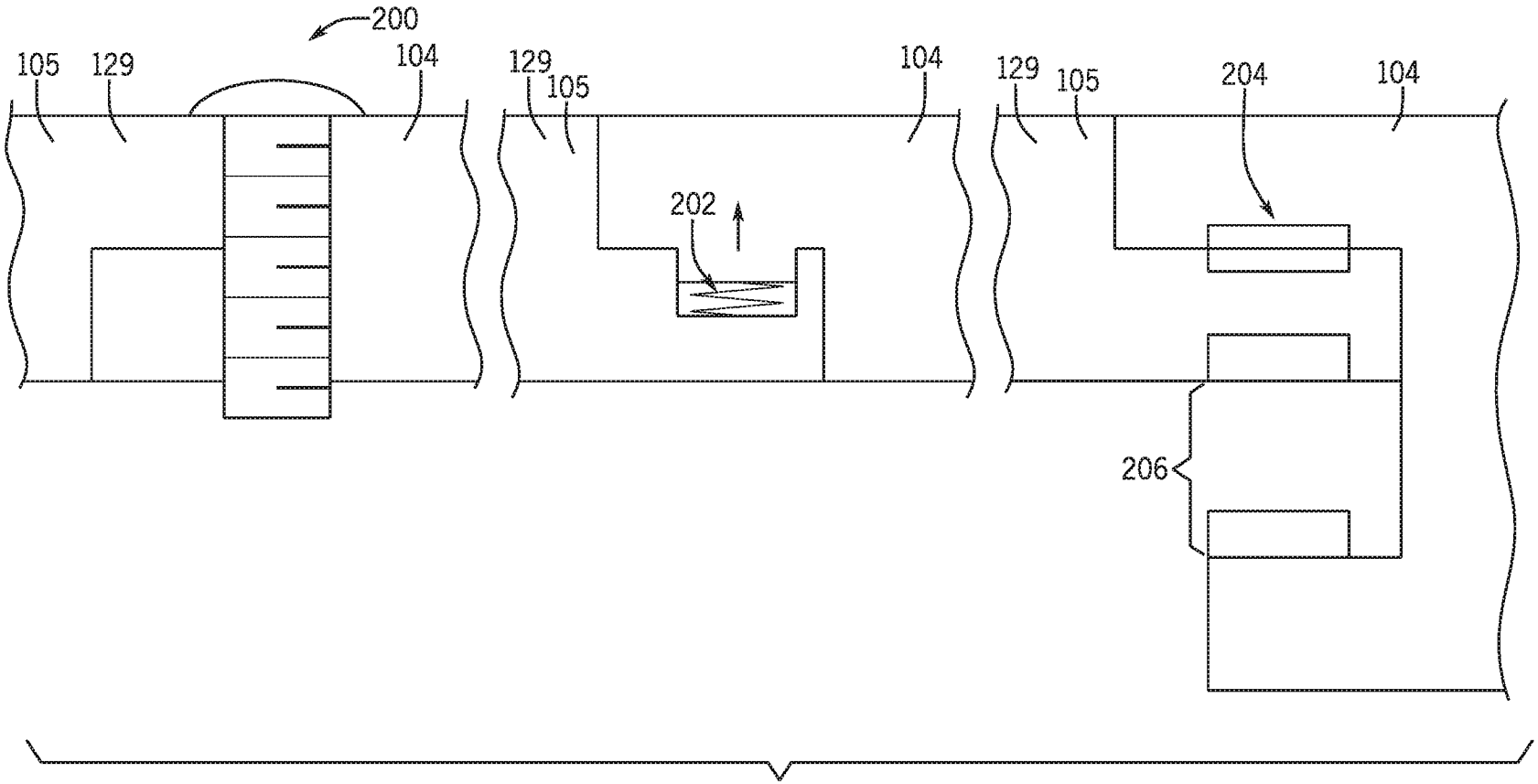
FIG. 19 is a schematic cross-sectional view of various connection features of a movable fan assembly and a cabinet of a condenser unit, in accordance with an aspect of the present disclosure.

FIG. 19 is a schematic cross-sectional view of various connection features of an embodiment of a movable fan assembly and a cabinet, such as a cabinet of a condenser unit. For example, the cabinet 105 and the movable fan assembly 104 may be connected via a fastener in the shipping position, the operational position, or both. Additionally or alternatively, the cabinet 105 and the movable fan assembly 104 may be connective via a spring 202 that is compressed in the shipping position and expanded in the operational position. Additionally or alternatively, the cabinet 105 and the movable fan assembly 104 may be connected via one or more magnetic connections 204, 206. For example, one magnetic connection 204 may be utilized while the movable fan assembly 104 is in the shipping position, and the other magnetic connection 206 may be utilized while the movable fan assembly 104 is in the operational position.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An outdoor condenser unit, comprising:

a cabinet defining a cabinet interior configured to house components of the outdoor condenser unit, wherein the cabinet includes an opening defining an air flow path between the cabinet interior and an external environment surrounding the outdoor condenser unit;

a fan assembly including fan blades and a fan motor coupled to the fan blades and configured to drive the fan blades into rotation; and a fan movement assembly configured to enable movement of the fan assembly through the opening and between a shipping position in which the fan assembly is disposed entirely within the cabinet interior and an operational position in which the fan assembly extends partially or entirely outside of the cabinet interior into the external environment.

2. The outdoor condenser unit of claim 1, wherein the fan assembly includes a fan blade housing in which the fan blades are disposed, and a grill coupled to the fan blade housing.

3. The outdoor condenser unit of claim 1, wherein the fan movement assembly includes a rail and the fan assembly includes an extension configured to engage the rail and enable movement of the fan assembly relative to the rail.

4. The outdoor condenser unit of claim 3, wherein the rail includes a groove or slot configured to receive the extension.

5. The outdoor condenser unit of claim 1, wherein the fan movement assembly includes a fastener configured to retain the fan assembly in the shipping position, enable movement of the fan assembly through the opening and between the shipping position and the operational position, and retain the fan assembly in the operational position.

6. The outdoor condenser unit of claim 5, wherein the fastener is configured to retain engagement between the fan assembly and the cabinet during movement of the fan assembly through the opening and between the shipping position and the operational position.

7. A heating, ventilation, and/or air conditioning (HVAC) system, comprising:

an HVAC unit, comprising:

a cabinet defining a cabinet interior configured to house components of the HVAC system, wherein the cabinet includes a wall having an opening defining an air flow path between the cabinet interior and an external environment surrounding the cabinet;

a fan assembly including fan blades, a blade housing, and a grill mounted to the blade housing; and a fan movement assembly configured to enable movement of the fan assembly through the opening and between a shipping position in which the fan assembly is disposed entirely within the cabinet interior and an operational position in which the fan assembly extends partially or entirely outside of the cabinet interior into the external environment; and an additional HVAC unit stacked with the HVAC unit such that the additional HVAC unit interfaces with the wall of the HVAC unit, wherein the additional HVAC unit comprises:

an additional cabinet defining an additional cabinet interior configured to house additional components of the HVAC system, wherein the additional cabinet includes an additional opening defining an additional air flow path between the additional cabinet interior and the external environment surrounding the additional cabinet;

an additional fan assembly including additional fan blades, an additional blade housing, and an additional grill mounted to the additional blade housing; and an additional fan movement assembly configured to enable movement of the additional fan assembly through the additional opening and between an additional shipping position in which the additional fan assembly is disposed entirely within the additional cabinet interior and an additional operational position in which the additional fan assembly extends partially or entirely outside of the additional cabinet interior into the external environment.

8. The HVAC system of claim 7, wherein the fan assembly includes a fan motor coupled to the fan blades and configured to drive the fan blades into rotation.

9. The HVAC system of claim 7, wherein the fan movement assembly includes a rail and the fan assembly includes an extension configured to engage the rail and enable movement of the fan assembly relative to the rail.

10. The HVAC system of claim 9, wherein the rail includes a groove or slot configured to receive the extension.

11. The HVAC system of claim 7, wherein the fan movement assembly includes a fastener configured to retain the fan assembly in the shipping position, enable movement of the fan assembly through the opening and between the shipping position and the operational position, and retain the fan assembly in the operational position.

12. The HVAC system of claim 11, wherein the fastener is configured to retain engagement between the fan assembly and the cabinet during movement of the fan assembly through the opening and between the shipping position and the operational position.

13. The HVAC system of claim 7, including a condenser section having the cabinet.

14. The HVAC system of claim 7, comprising a cover separate from the HVAC unit, separate from the additional HVAC unit, and extending between the wall and the additional HVAC unit.

15. The outdoor condenser unit of claim 1, wherein the cabinet comprises a cabinet wall through which the opening defining the air flow path extends, and the cabinet wall is configured to contact an additional cabinet wall of an additional HVAC unit in a stacked arrangement.

* * * * *